US005405139A

United States Patent [19]

Gagarin

[11] Patent Number: 5,405,139

[45] Date of Patent: Apr. 11, 1995

[54] GOLF SWING IMPROVEMENT DEVICE

[76] Inventor: Andrew S. Gagarin, 4 Lighthouse Point Rd., Watch Hill, R.I. 02891

[21] Appl. No.: 241,295

[22] Filed: May 11, 1994

[51] Int. Cl.[6] ..... A63B 69/36

[52] U.S. Cl. ..... 273/186.2; 273/193 B

[58] Field of Search ..... 273/186.2, 193 R, 193 B, 273/193 A, 187.3, 187.4

[56] References Cited

U.S. PATENT DOCUMENTS

| | | | |
|---|---|---|---|
| 4,118,033 | 10/1978 | Miyamoto | 273/186 A |
| 4,511,147 | 4/1985 | Olsen | 273/193 A |
| 4,664,388 | 5/1987 | Huber | 273/186 A |
| 4,953,868 | 9/1990 | Thompson et al. | 273/186.2 |
| 5,026,063 | 6/1991 | Rhodes | 273/186 A |
| 5,100,147 | 3/1992 | Smith | 273/186.2 |

*Primary Examiner*—George J. Marlo

[57] ABSTRACT

A golf swing training device comprised of a shaft with a grip over which a tubular elastomeric member is fitted. The tubular elastomeric member has one end affixed adjacent to the grip and the other end may be weighted. A portion of the tubular elastomeric member is unsupported by the shaft so that it is free to flex in all planes. The tubular elastomeric member is entirely unrestrained along its longitudinal axis, so that it is free to extend in response to centrifugal forces. The shaft which extends centrally through part of the tubular elastomeric member offers sufficient support to allow the device to be swung rhythmically back and forth without collapsing, while the flexibility and elasticity of the tubular elastomeric member provide a unique feel of swinging the clubhead.

11 Claims, 4 Drawing Sheets

GOLF SWING IMPROVEMENT DEVICE

BACKGROUND-FIELD OF INVENTION

This invention is a golf swing improvement device designed to teach golfers of all levels how to correctly swing a golf club.

BACKGROUND OF INVENTION

In order to master the game of golf it is necessary to have a proper swing which involves the coordinated movement of the entire body both on the backswing and on the downswing. Due to the seemingly complex nature of the golf swing and the focus of most instruction on its many individual components, only a very small percentage of the people pursuing the game are able to attain a proper swing.

More specifically, the central element in a proper swing involves accelerating the clubhead with the smooth application of centrifugal force. What is needed is a practice device which will teach golfers a proper swing based on this principle.

In order to teach this type of swing, the device should have several characteristics. It should be able to be swung in a manner similar to a standard golf club while at the same time accentuating the user's feel and awareness of the clubhead. The device should be able to be swung continuously back and forth so the user can develop rhythm and muscle memory and it should provide both a visual and tactile feedback as to whether or not a correct swing is being achieved. Once the user has mastered the correct swing in the above manner, the device should then be able to be swung starting from the normal stationary address position as is done with a real club. In addition, this device should be able to show the golfer how to swing harder with the proper swing since the ability to hit the ball a long distance is a central element of the game. Finally, the device should teach the golfer proper wrist release which is a central element in distance and control.

DESCRIPTION OF PRIOR ART

There have been many patented devices which attempt to teach a correct swing. Some of these devices are discussed below.

There are currently a number of weighted swing trainers on the market which employ a relatively stiff shaft and a weighted head. One such club is the Assist by Matzie, covered by U.S. Pat. No. 4,511,147 (1985) to Olsen. In addition there are various donut shaped weights which may by slipped onto a golf club's shaft for warming up and practice swinging. The basic problem with this class of swing trainers is that the clubhead is rigidly attached to the shaft. Therefore, a golfer can forcefully manipulate the shaft and clubhead with an improper swing while the device provides no means of feedback to indicate that anything is wrong. In addition, the fixed solid connection between the shaft and the head impairs the user's ability to learn the feeling of swinging the clubhead and thus learn a proper swing.

Next, there are a group of clubs with a flexible shaft and a weighted head. U.S. Pat. No. 4,118,033 (1977) to Miyamoto, describes a club with a flexible shaft composed of composite core member with stranded steel wire and a weighted head. Further, U.S. Pat No. 5,026,063 (1991) to Rhodes is for a similar flexible club with a shaft of extruded tubular plastic. This type of swing trainer suffers from the same deficiency as those with stiff shafts in that the clubhead and the shaft form one integral solid unit. As with the clubs mentioned earlier, they can be manipulated and provide no means of feedback to indicate whether or not the clubhead is being swung with centrifugal force in the proper manner.

Furthermore, while the swing trainers described above may be somewhat distinguished by their degree of flex, none of them are elastic along their longitudinal axis so that they are able to extend when swung. It has been found that the ability of the flexible part of the shaft to extend in response to the centrifugal force applied to the clubhead dramatically increases the student's ability to feel the clubhead and as a result quickly learn a proper swing.

At the other end of the spectrum of flexibility there is the trainer embodied in U.S. Pat. No. 4,664,388 (1986) to Huber. This is a practice device comprising a ball suspended by a cord from the end of a shaft. While the ball in this device cannot be manipulated and must be swung with pure centrifugal force, it is extremely difficult to swing. If centrifugal force is not continuously applied to the ball, the string collapses. Even in the best case, if the student can learn to swing the device, the ball hits the student both on the backswing and the foreswing which is distracting if not dangerous. Finally, the inelastic nature of the string limits the user's feel of the clubhead.

SUMMARY OF THE INVENTION

In view of the foregoing, this invention is a new and improved practice device and training aid for quickly learning a proper golf swing.

This practice device comprises an elongate golf shaft with a golf grip disposed over, affixed to and defining the upper portion thereof. A tubular flexible elastomeric member having a length substantially greater than that of the lower portion of the shaft is disposed over said lower portion, the upper end of said tubular member being attached to said shaft substantially adjacent the grip and said tubular elastomeric member being stretchable so as to elongate in response to centrifugal forces imposed thereon during practice swinging of the device. In a preferred embodiment of the invention a weight, which is preferably in the nature of a ball, is attached to the lower end of the tubular elastomeric member.

OBJECTS OF THE INVENTION

It is the object of this invention to produce a practice club which will teach a golfer of any level a proper golf swing based on centrifugal force.

Another object of this invention is to produce a practice device which will expedite the learning process because it can be swung either continuously back and forth, or from the address position.

Another object of this invention is to provide a practice device which will aid the learning process by providing both visual and tactile feedback so the user becomes instantly aware of whether or not it is being swung correctly.

A further object of this invention is to provide a device which will show the user the proper body and arm motions which must be employed in order to swing with more power.

A still further object of this invention is to provide a device which will show the user proper wrist release, and full extension of the arms.

Figure 1:
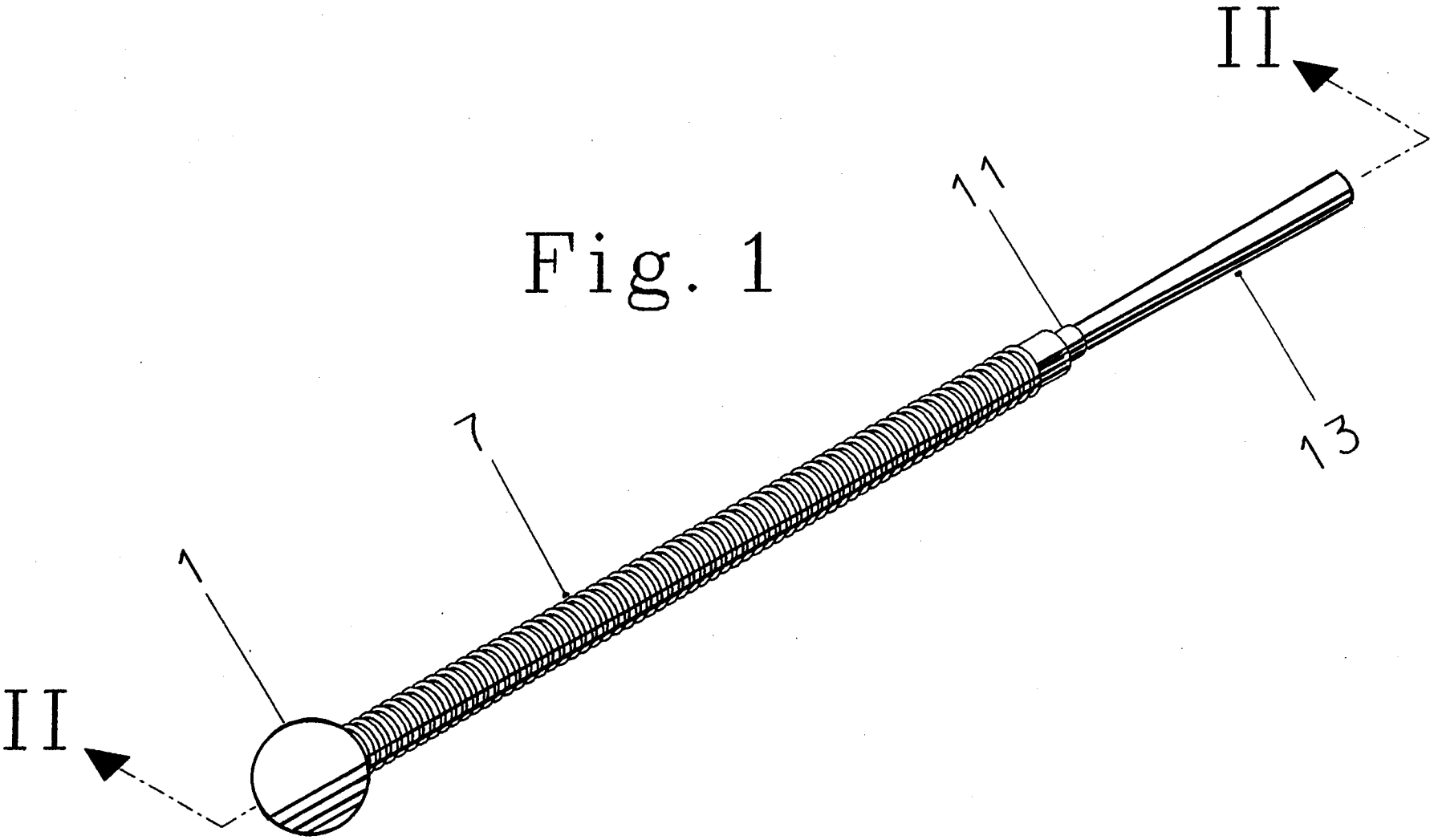
FIG. 1 is a perspective view of an embodiment of a golf swing improvement device in accordance with the invention.

| REFERENCE NUMERALS IN DRAWINGS | |
|---|---|
| 1. spherical ball | 9. plastic cap |
| 2. weight | 10. internal bushing |
| 3. hollow wall anchor | 11. fixed bushing |
| 4. eyebolt | 12. tension pin |
| 5. bushing | 13. grip |
| 6. tension pin | 14. ½ inch PVC pipe |
| 7. tubular elastomeric member | |
| 8. shaft | |

DESCRIPTION OF THE PREFERRED EMBODIMENT

Figure 2:
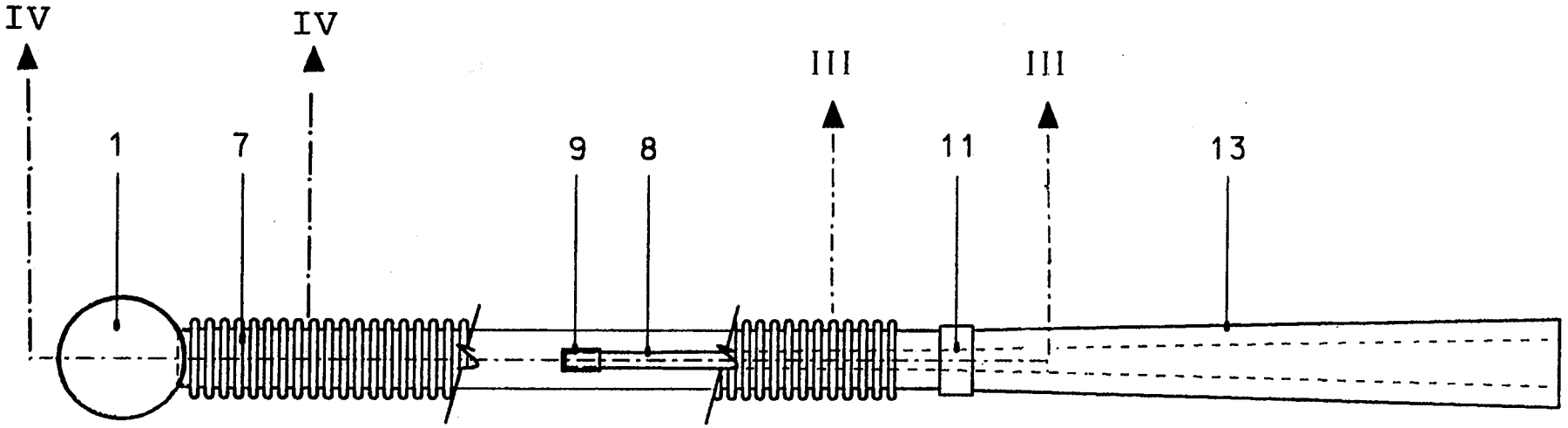
FIG. 2 is a partially sectional side view of the device of FIG. 1, taken along lines II—II thereof.

A perspective view of the golf swing improvement device embodying this invention is shown in FIG. 1. Referring to FIG. 2, the invention is basically comprised of a standard golf club shaft 8, which extends inside a tubular elastomeric member 7 for a portion of length. The tubular elastomeric member 7 has a weighted ball 1 attached at the end.

A standard golf club grip 13 is glued onto the shaft 8. The composition of the shaft is not important and may be either a standard metal golf club shaft approximately thirty six inches in length, or one made of wood or plastic. A plastic cap 9 is glued over the bottom end of the shaft and allows the tubular elastomeric member 7 to extend and contract without becoming caught on the tip of the shaft 8.

The upper end of the tubular elastomeric member 7 is attached to the shaft directly adjacent the grip 13. In the original embodiment of this device, the tubular elastomeric member consists of a standard vacuum cleaner hose for a Royal Dirt Devil model 192 hand vacuum. Three and one quarter inches of the hose nozzle and two inches of the opposite end were cut off to produce a hose with a total length of thirty seven inches. While the total length of the tubular elastomeric member may vary depending upon its elasticity, and the height of the user, its overall length should fall within the range of from thirty to forty inches. While somewhat stiffer and less elastic, either polyvinylchloride (PVC) or polyethylene 1¼' sump pump hose may be used. Because it is stiffer and less elastic than vacuum cleaner hose, it is more suitable for a swing improvement device designed for a large man or one with a high swing speed. It is envisaged that the device may be sold with several interchangeable tubular elastomeric members that have different lengths and spring rates.

The length of the portion of the shaft 8 which extends inside the tubular elastomeric member 7 is critical to the performance of the swing trainer. The shaft must extend far enough inside the tubular elastomeric member to prevent said member from collapsing completely and hitting the user during the start of the swing and the pause at the top of the backswing. However, enough of the tubular elastomeric member must hang unrestrained off the bottom end of the shaft so that it is free to flex in all planes and to extend in response to centrifugal force applied by a golfer's swing. For the trainer to perform properly, approximately twenty to forty percent of the tubular elastomeric member should be unrestrained by the shaft, with the ideal being near thirty percent.

The connection point of the upper end of the tubular elastomeric member 7 to the shaft 8 substantially adjacent the grip 13 is important in that it allows the maximum length of tubular elastomeric member to stretch in response to centrifugal forces applied to the weighted ball 1 during a practice swing. It also creates a unique feel of the clubhead extending directly from the user's hands.

Figure 3:
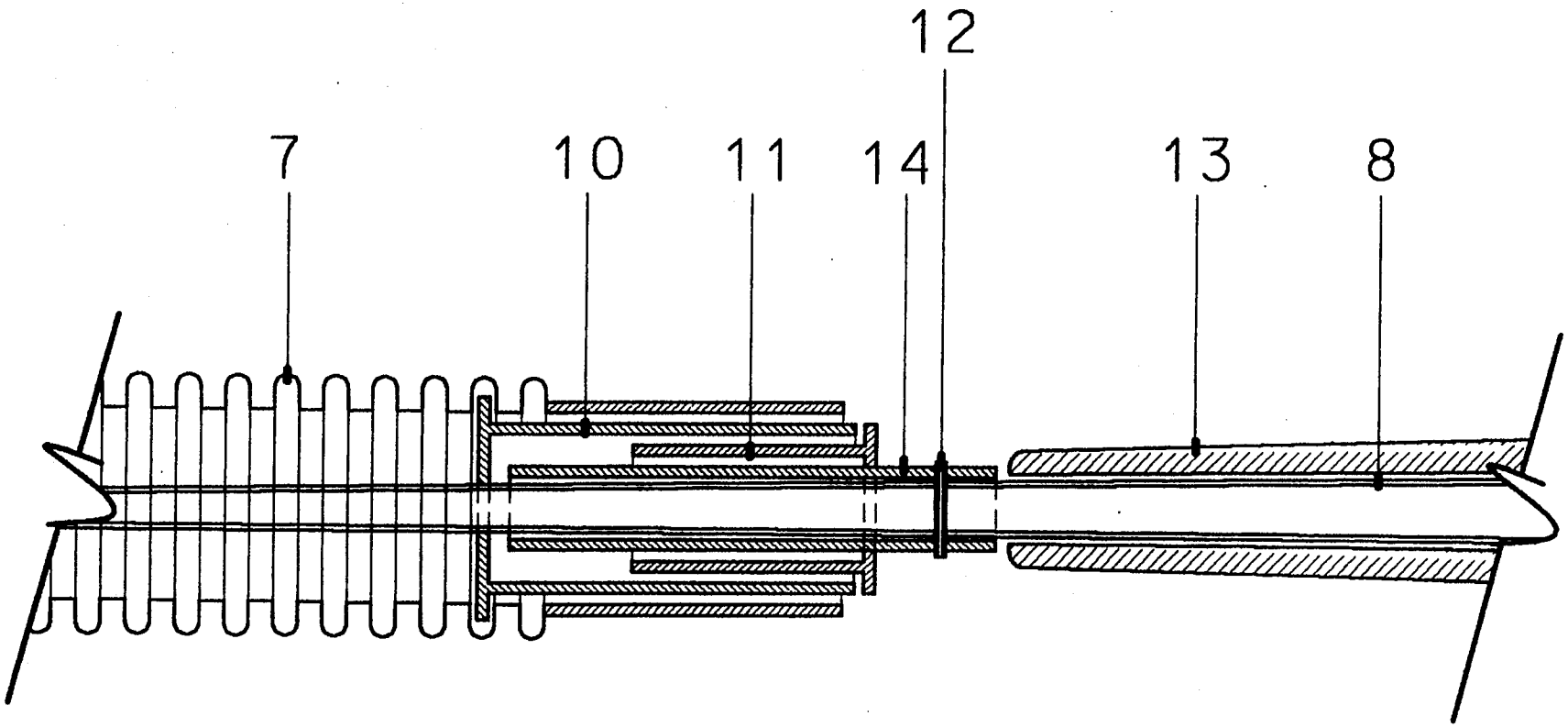
FIG. 3 is an enlarged sectional view of a mid-portion of the device of FIG. 2, taken between lines III—III thereof.

Referring to FIG. 3, the standard Red Devil model 192 hose is manufactured with an internal plastic bushing 10 having a raised lip on one end. The lip engages in the ribbed portion of the hose 7 allowing it to rotate freely while preventing it from being withdrawn. A standard ¾' to ½' PVC reducing bushing 11 is cemented to the internal rotating bushing 10. A piece of standard ½ inch PVC pipe 14 is cemented inside the bushing 11 so that the assembly will fit snugly onto the shaft 8. The bushing 14 is then secured to the shaft with a tension pin 12. This allows the tubular elastomeric assembly to be changed by removing tension pin 12, and inserting a different assembly over the shaft. In models of this device in which it is not anticipated that the tubular elastomeric member will be changed, the bushing 11 may be permanently attached to the shaft with epoxy glue.

The ability of the tubular elastomeric member 7 to rotate freely about the shaft 8 allows it to always droop straight down in line with the shaft so the user may take a proper grip without the elastomeric member applying a torsional force to the shaft.

While the swing improvement device will function adequately in this form, performance is greatly improved if some additional weight is added to the free end of the tubular elastomeric member.

Figure 4:
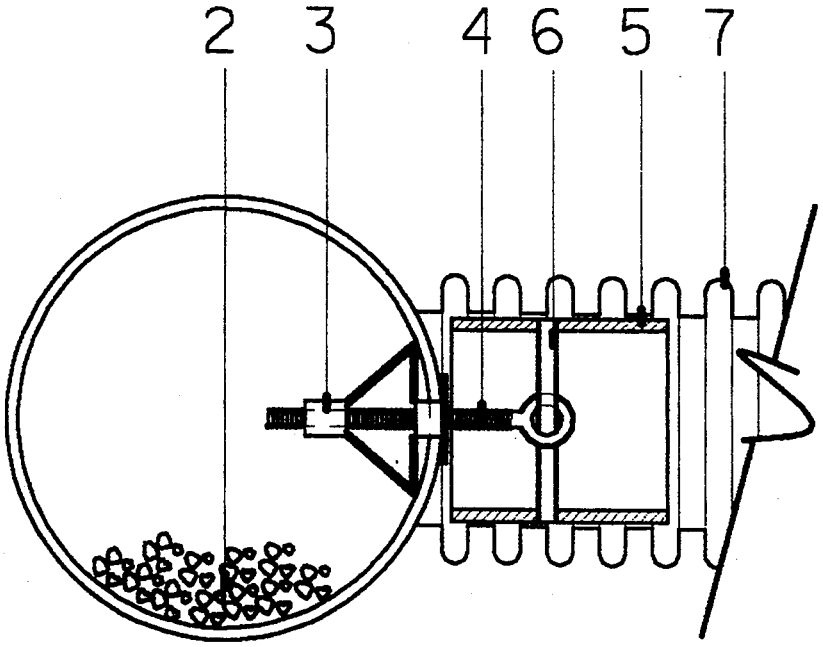
FIG. 4 is an enlarged sectional view of the lower portion of the device of FIG. 2, taken between lines IV—IV thereof.

Referring to FIG. 4, bushing 5 is made of standard ¾' PVC pipe. A hole is drilled in the bushing to accept tension pin 6 which holds a threaded eyebolt 4 in place. The bushing 5 is then glued inside the end of tubular elastomeric member 7.

A hollow spherical ball 1 is fitted with a standard hollow wall anchor 3. The ball 1 is attached to the end of the tubular elastomeric member 7 by screwing the eyebolt 4 into the hollow wall anchor. A weight 2 in the form of sand or other similar material is added to the ball 1 by pouring it through the hole in the center of the hollow wall anchor 3 when it is unscrewed from the eyebolt 4. The total weight of the ball 1 and hollow wall anchor should be in the range of one to three ounces. The total weight of the ball 1 may be changed at any time by unscrewing it from the eyebolt 4 and either adding or withdrawing sand from the hole in the hollow wall anchor. This feature allows the weight of the ball to be customized to produce the maximum feel for different types of the elastomeric member which have differing coefficients of elasticity. In addition, the weight may be varied in relation to the size and swing speed of the user.

The overall length of the device should fall into the range of from forty to fifty two inches depending on the elasticity of the tubular elastomeric member being used and the size person for whom the device is designed. Although tests have shown that devices several inches longer than the standard driver length of 44' maximize the feel of the clubhead and produce the steepest learning curve in the majority of golfers, proportionally shorter clubs also work. It is anticipated that in the future several models will be produced in shorter lengths including a junior model.

A student golfer first using this swing trainer is instructed to swing the device back and forth in such a way that the ball 1 and tubular elastomeric member 7 extend straight out from the grip 13 and the ball 1 does not hit the ground. The student is able to quickly learn a proper swing using pure centrifugal force because the ball will extend straight out and not hit the ground only if the device is swung by smoothly accelerating the ball with centrifugal force. Any attempted manipulation of the device, or any jerky movement, will result in the ball either striking the ground or not extending straight out. This provides immediate feedback to the user so that the swing can be immediately adjusted to achieve the desired result.

The ability of the student to learn quickly is aided by the fact that the shaft of the club extends inside the tubular elastomeric member for approximately sixty to seventy percent of its length, and the tubular elastomeric member has some rigidity, unlike a string, thus preventing it from collapsing when the ball changes direction at the end of the foreswing and backswing.

In addition, the full length of the tubular elastomeric member extends in response to centrifugal force as the golfer swings. This causes the user to feel the sensation that the head of the club is pulling the hands outward in the plane of the swing and encourages a full extension to the arms and the widest pure arc the golfer is capable of.

As the device is swung through the imaginary hitting area, the momentum of the ball forces the golfer to have a proper wrist release. If the user tries not to release the wrists through the hitting area, the ball begins to lead the shaft and tubular elastomeric member. This acts like a weight on the end of a fulcrum forcing a correct wrist release.

After the golfer has swung the device for several minutes, he is asked to try and swing it harder. It is immediately apparent that the club can only be accelerated with the smooth application of power coming from the left shoulder area. Any attempted acceleration of the golf swing improvement device with the hands at the top of the backswing results in the ball hitting the ground. This is called hitting from the top with the hands and is a common swing error. The immediate feedback of the ball hitting the ground, coupled with increased feel of the clubhead provided by the tubular elastomeric member, aid the user in correcting this fault.

What is claimed is:

1. A golf swing practice device for use in developing correct swing movements, said device comprising, in combination:

a golf shaft having upper and lower portions, said upper portion being defined by a golf grip disposed over and affixed thereto;

an elongate flexible tubular elastomeric member disposed over said lower portion of said shaft, said elongate tubular elastomeric member having upper and lower ends, said upper end being affixed to said shaft substantially adjacent said grip and said tubular elastomeric member having a length substantially greater than said lower portion of said shaft and being stretchable so as to elongate in response to centrifugal forces imposed thereon during practice swinging of the device.

2. The device of claim 1 comprising, in addition, a weight affixed to said lower end of said elongate tubular elastomeric member.

3. The device of claim 2 wherein said weight is a ball.

4. The device of claim 1 wherein said affixation of the upper end of said tubular elastomeric member to said shaft is journalled such that said tubular elastomeric member is free to rotate about said lower portion of said shaft.

5. The device of claim 1 wherein said tubular elastomeric member is a corrugated hose.

6. The device of claim 1 wherein said tubular elastomeric member has a length of between about 120 and about 140% of the length of said lower portion of said shaft.

7. A golf swing practice device for use in developing correct swing movements, said device comprising, in combination:

a golf shaft having upper and lower portions, said upper portion being defined by a golf grip disposed over and affixed thereto;

a plurality of flexible elastomeric tubular members, each said elastomeric tubular member being disposable over said lower portion of said shaft, having upper and lower ends, being of a length substantially greater than the length of said lower portion of said shaft and being stretchable so as to elongate in response to the centrifugal forces imposed thereon during practice swinging of the device, said tubular members having different spring rates, one from the other; and means to selectively detachably affix the upper end of each said elastomeric tubular member to said shaft, substantially adjacent said grip.

8. The golf swing practice device of claim 7 comprising, in addition, a weight affixable to the lower end of each said tubular elastomeric member.

9. The golf swing practice device of claim 7 wherein said means to detachably affix the upper end of each said elastomeric tubular member to said shaft is journalled such that said detachably affixed elastomeric tubular member is free to rotate about said lower portion of said shaft.

10. The golf swing practice device of claim 7 wherein each of said plurality of tubular elastomeric members is a corrugated hose.

11. The golf swing practice device of claim 7 wherein each of said plurality of tubular elastomeric members has a length of between about 120 and about 140% of the length of said lower portion of said shaft.

* * * * *